US005353444A

United States Patent [19]

Osmond

[11] Patent Number: 5,353,444

[45] Date of Patent: Oct. 11, 1994

[54] PRIMER ACTIVATED WET LEG-CONTROL VENTED LOW LEVEL SYPHON FLUSH FOR TOILETS

[76] Inventor: John S. Osmond, 731 Cedar St., Santa Monica, Calif. 90405

[21] Appl. No.: 62,132

[22] Filed: May 12, 1993

Related U.S. Application Data

[63] Continuation-in-part of Ser. No. 951,837, Sep. 28, 1992, Pat. No. 5,243,714, which is a continuation-in-part of Ser. No. 695,402, May 3, 1991, Pat. No. 5,230,102.

[51] Int. Cl.[5] ..... E03D 1/06

[52] U.S. Cl. ..... 4/370

[58] Field of Search ..... 4/368–370, 4/374, 376, 377

[56] References Cited

U.S. PATENT DOCUMENTS

| | | | |
|---|---|---|---|
| 529,584 | 11/1894 | Booth | 4/368 |
| 1,562,585 | 11/1925 | Phillipps | 4/370 |
| 3,973,751 | 8/1976 | Brugnolic et al. | 4/368 X |
| 5,243,714 | 9/1993 | Osmond | 4/370 |

FOREIGN PATENT DOCUMENTS

| | | | |
|---|---|---|---|
| 0029500 | 8/1907 | Austria | 4/377 |
| 0017666 | of 1889 | United Kingdom | 4/376 |
| 0012717 | of 1893 | United Kingdom | 4/76 |
| 0003023 | of 1894 | United Kingdom | 4/376 |

*Primary Examiner*—Charles E. Phillips
*Attorney, Agent, or Firm*—William H. Maxwell

[57] ABSTRACT

A toilet flushing apparatus characterized by a closed primer tank and an inherently leakproof syphon discharge through a toilet flush tube, also characterized by a pre-primed syphon, wherein the discharge leg is filled to the syphon bridge and the suction leg can be filled to a level substantially below the bridge, and with a releasable floating flush valve and means for retarding discharge of primer tank water to initiate syphoning, the primer tank being automatically refilled with the rise of float controlled supply tank water.

13 Claims, 3 Drawing Sheets

PRIMER ACTIVATED WET LEG-CONTROL VENTED LOW LEVEL SYPHON FLUSH FOR TOILETS

Reference is made to Disclosure Document No. 267780 entitled PRIMER JET TOILET FLUSHER, filed in the United States Patent & trademark Office Nov. 20, 1990, this application being a continuation in part of my application Ser. No. 07/951,837 filed Sep. 28, 1992 now U.S. Pat. No. 5,243,714 as a continuation in part of my application Ser. No. 07/695,402 filed May 3, 1991 now U.S. Pat. No. 5,230,102.

BACKGROUND OF THE INVENTION

A flushing apparatus for toilets common in the United States involves a reseating flush valve the holds a minimized volume of supply water in a tank from which it is suddenly released into the toilet bowl. And, a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in continued water waste.

Another flushing apparatus, common in the United Kingdom, involves a syphon tube having its suction leg depending into the supply tank so as to be partially filled with water, and its discharge leg normally empty of water and opening into the toilet bowl, and operated by means of a primer pump that is manually actuated to fill the syphon legs and thereby initiating syphoning. The said primer pump operates as a water lifting means in the suction leg of the syphon, and the advantage of this syphon system is that there can be no leakage from the supply tank through the inactive syphon.

A feature of state of the art toilets is the low volume of storage tank water required for flushing, this minimal flush water requirement being, characterized by low level water storage the supply tank, a typical condition in the United States, and a mandatory level condition in the United Kingdom. Accordingly, difficulty is experienced in lifting supply tank water sufficiently to initiate the syphon function necessary for flushing. In the United Kingdom there is a requirement that there be a "Warning. Pipe" and more particularly an overflow pipe placed in the supply tank a substantial distance below the bridge of the syphon. This distance is specified as 64 mm a requirement which has an adverse effect on the primer tank activated syphon of the present invention. In this respect, it has been discovered that indiscriminately rapid discharge of primer tank water is or can be ineffective to start the syphon function. Accordingly, it in an object of this invention to discriminately discharge primer tank water so that initiation of the syphon function is assured when subjected to said low water level conditions.

It has been discovered by a reduction to practice of the present invention that suction leg water of the syphon does not lift over the syphon bridge when the primer tank water discharges too quickly, due to the related inertia of water to be lifted in the suction leg. Time is of the essence, in that time for induction of water up and over the syphon bridge is a fundamental requirement. Accordingly, it is an object of this invention to retard the drop and/or discharge of water in and from the primer tank and over the jet opening that initiates the syphon function. In practice, this is accomplished by closing the primer tank to outside atmosphere and restricting the admission of air thereto, whereby a partial vacuum is established over the primer tank water so as to retard its drop and prolong its effective discharge. This air inlet restriction is also necessary as a vent that enables filling of the primer tank. Functionally, as the primer tank water drops, it sucks air through a restriction and creats a negative pressure within the primer tank and thereby retards the drop and discharge of water therefrom. This increases the effective time interval that draws suction leg water up and over the syphon bridge. This unique air restriction is adjustable.

In view of the foregoing, it is an object of this invention to employ the aforesaid syphon tube fush principle of operation to the exclusion of pump means, and replacing the aforesaid pump-type primer means with a controlled syphon primer means activated by opening of the flush valve, all in combination with an otherwise conventional United States or United Kingdom state of the art toilet.

The syphon principle of operation is superior with respect to the conservation or water, in that there can be no continuous leakage therethrough when its discharge leg is empty or water. And, only when the discharge leg is primed does water flow therethrough. On the contrary, the conventional flush valve principle of operation is prone to continuous leakage from the water supply tank and through the flush tube, due to deterioration of either the valve seat or valve ball.

It is to be understood that the water supply tank is refilled after each flushing operation, or incomplete flushing operation, by means of a conventional and accepted water level responive valve means from a water supply service pipe. In practice, a float controlled valve returns the tank water level to a predetermined point.

The syphon principle of operation is characterized by two conditions, a passive condition wherein the discharge leg is closed to the flush pipe by the flush valve and the primer tank is in open communication with and to fill the discharge leg with water up to the syphon bridge and with a transfer passage over the bridge and between the two syphon legs that are empty and vented to outside atmosphere, and a functioning condition wherein the discharge leg is opened to the flush pipe by lifting the flush valve, a float, and opening the primer tank for controlled discharge of water over a jet opening of the discharge leg and into the flush pipe and inherently closing the atmosphere vent to said transfer chamber.

The flush valve closes the discharge leg below the bottom opening of the primer tank, the bottoms of the primer tank and discharge leg being separated by the jet opening and in open communicaton. In order to achieve said functioning condition, priming of the sypon is equired for filling the otherwise empty transfere passage with water, whereupon syphoning action is initiated and continues to occur.

The apparatus herein disclosed is characterized by the atmospheric closure of the transfer passage in the flush mode, which is a prerequisite to successful flushing, and to this end it is an object of this invention to provide vent control means by which the transfer passage is closed to atmosphere in the flush mode, said vent being open to atmosphere in the passive mode in order to enable filling of the two syphon legs.

SUMMARY OF THE INVENTION

This invention relates to water closets or toilets and particularly to the flushing apparatus therefor by which defication and urnination etc. is disposed of as sewage. Heretofore, substantial quantities of water have been wasted by the flushing apparatus employed, as by inherent leakage and by mechanical deterioration resulting in malfunction and/or insufficient operation requiring repeated flushing attempts. The United States flush valve type of apparatus that is manually activated to open the conventional flush tube is subjected to low volume or low tank level requirements, while the United Kingdom syphon apparatus is subjected to a depressed supply tank water level. Therefore, it is an object of this invention to combine the advantages of the non-leak syphon with a discretely controlled primer means, whereby initiation of the syphon function is assured, even when using a small volume of water.

The toilet flushing apparatus herein disclosed is primer tank activated, simply by flooding the flush pipe with water at velocity from a syphon discharge tube in order to initiate syphoning that deplets the water supply tank during each flushing operaton. Accordingly, this invention is characterized by a syphon discharge and a flush tube, and by a rechargeable primer tank that estabishes a head of primer water that is controllably released by a partial vacuum to initiate syphoning. In practice, the syphon tube flow activation is such as to require but a pint or two of primer water, discharged at the bottom opening of the discharge tube of the syphon. It is to be understood that operation of this flushing apparatus is dependent upon refilling of the water supply tank by means of a water level control, such as a float controlled water level valve or the like, and so that the primer tank water returns to the bridge level of the syphon and refills the discharge leg, after each flushing operation.

The foregoing and various other objects and features of this invention will be apparent and fully understood from the followiong detailed description of the typical preferred forms and applications thereof, throughout which reference is made to the accompanying drawings.

THE DRAWINGS

Figure 2:
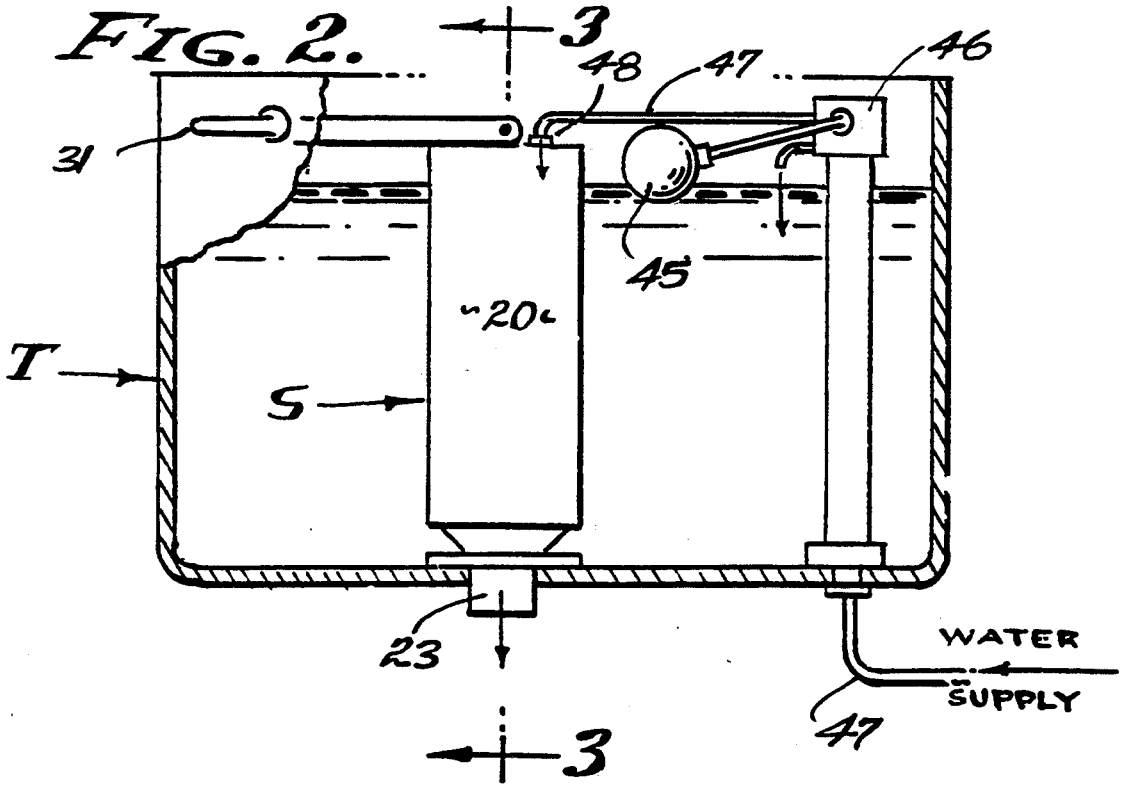
FIG. 2 is a sectional view taken as indicated by line 2—2 on FIG. 1, showing a passive ready condition.
Figure 4:
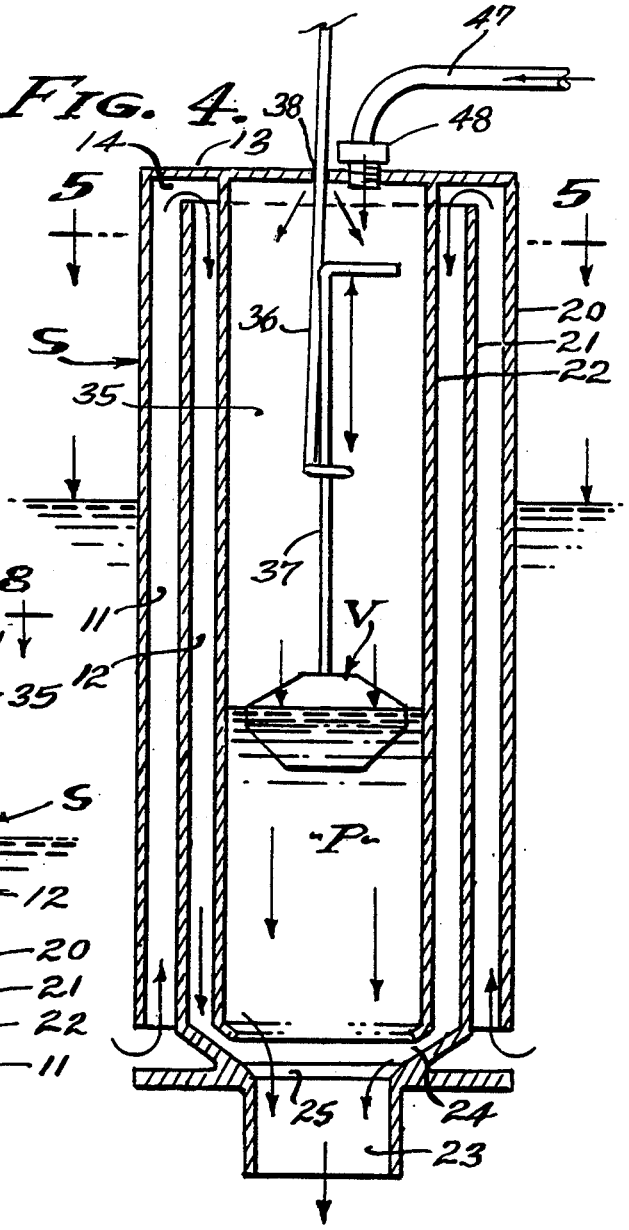
Figure 3:
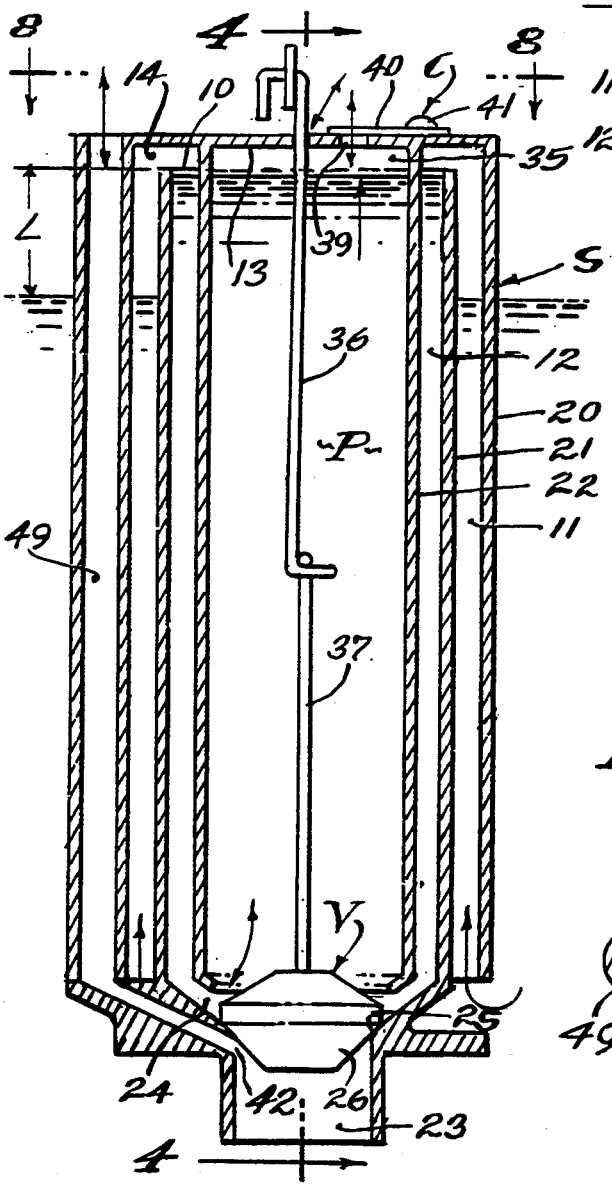
Figure 5:
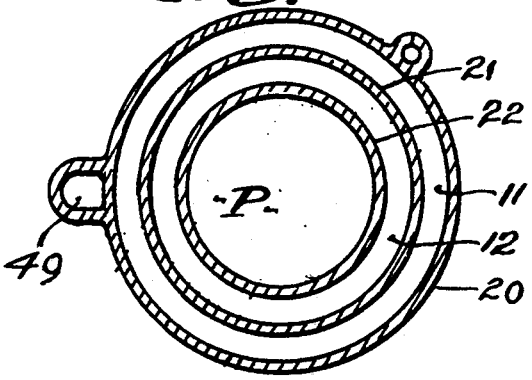

FIGS. 3 to 5 are enlarged sectional views, FIG. 3 being a vertical section taken as indicated by line 3—3 on FIG. 2, FIG. 4 being a vertical section showing the operated condition and taken as indicated by line 4—4 on FIG. 3, and FIG. 5 being a transverse section taken as indicated by line 5—5 on FIG. 4.

Figure 6:
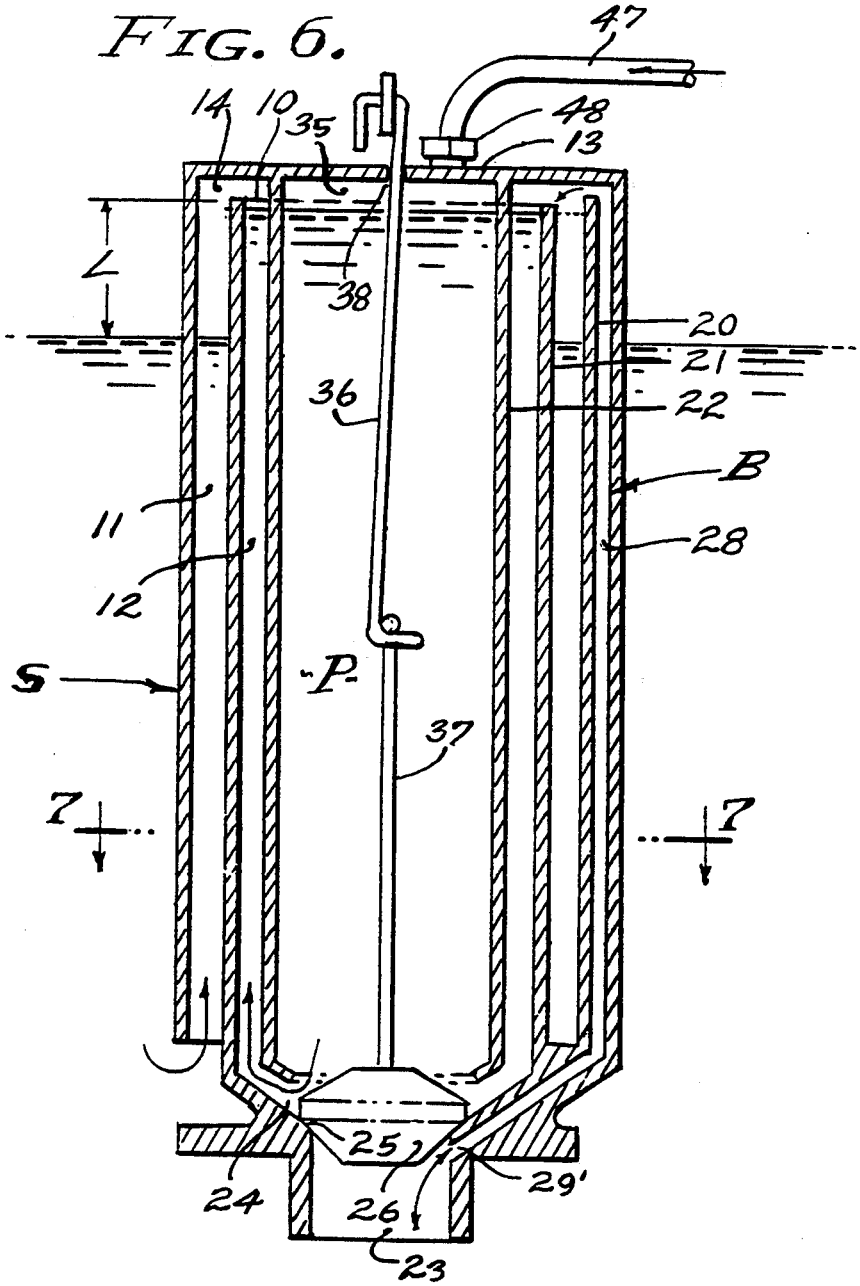

FIG. 6 is a vertical section similar to FIG. 3 showing the controlled breather.

Figure 7:
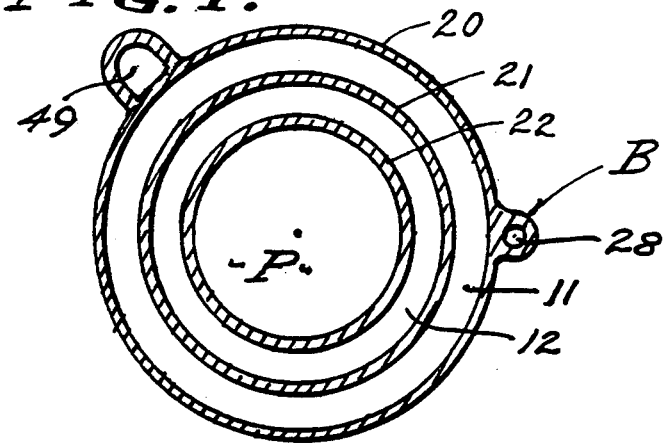

FIG. 7 is a transverse section taken as indicated by line 7—7 on FIG. 6.

Figure 8:
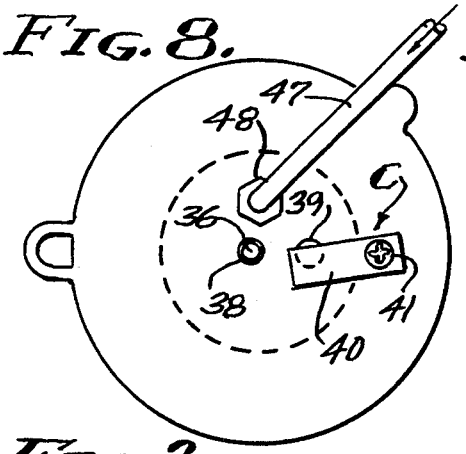

And, FIG. 8 is a plan view showing the top of the flushing apparatus and the controlled air vent into the primer tank, adjustable to retard the discharge of primer water over the jet opening that initiates the syphon function.

PREFERRED EMBODIMENT

Referring now to the drawings, the toilet and water supply tank T are conventional in every respect. And, the tank water level is controlled by a conventional float valve, so that the water supply level reaches a predetermined position well below a weir or bridge 10 of a syphons within the supply tank. In accordance with this invention, there is the syphon S comprised of a suction leg 11 and a discharge leg 12, preferably concentric tubes 21 and 22 wherein the suction leg 11 is an annulus that surrounds the discharge leg 12 opening into a flush pipe 23. The suction leg opens from the bottom of the tank T and over the bridge 10 and into the top of the discharge leg 12 via a transfer passage 14, the suction leg 11 being filled with tank water to the float controlled level. Transfer passage 14 closes the top of the annuli between tubes 20, 21 and 22 forming a passage joining the two legs. A feature is the annular configuration of the discharge leg 12 and its inwardly turned foot or bottom jet opening 24 discharging circumferentially into the flush pipe 23 when the flush valve V is lifted. The suction leg 11 and discharge leg 12 are refilled after each flushing. A flush handle 31 at the front of the supply tank is provided.

The toilet fixture is conventional, having a water supply tank T that is automatically filled with water by means of a float 45 controlled valve 46 from a water supply pipe 47. The water level in tank T is limited to a predetermined point well below the bridge 10 of the syphon S. The valve 46 discharges into the supply tank T and/or into the primer tank P in the usual manner, as is clearly shown in the drawings.

A feature herein disclosed is the syphon comprised of concentric tubes, wherein the suction leg 11 of the syphon surrounds the discharge leg 12 (see FIG. 5). The suction leg 11 opens from the bottom of the tank T and into the discharge leg 12 via the header transfer passage 14, the suction leg being filled with tank water to the bridge 10 level in the passive ready condition. Closely overlying the weir or bridge 10, there is an upper header 13, forming the closed transfer passage 14 at the joinder of the two legs, said passage being defined when the water level rises to a maximum at the bridge 10. A feature of this invention is that the header also closes the top of the primer tank P and features a vent-control means C, as will be described.

In accordance with this invention, the inner diameter wall of the discharge leg 12 is a tube 22 that forms a primer tank P closed at its top and closed by a flush valve V at its bottom and to the flush pipe 23. The flush valve V is a floatable ball valve or the like, passively seated at or within the jet opening 24. The circumferential jet opening 24 is slightly larger in diameter than the peripheral diameter of the flush valve V and substantially coincidental with the inside diameter of the flush pipe 23.

Referring now to the drawings, in the passive ready to flush condition, the apparatus provides wet legs 11 and 12, the flush valve being seated at the top of the flush pipe 23 and below the open bottom of the primer tank P and within and surrounded by the jet opening 24 (see FIG. 3). Accordingly, the inwardly turned discharge diameter of the jet opening 24 is greater in diameter than the peripheral diameter of the flush valve V, whereby the valve can be withdrawn upwardly therethrough so as to simultaneously open both the primer tank P and the jet opening 24 to the flush pipe 23 (see FIG. 4). The tube 22 is substantially greater in diameter than the flush valve V, so that there is free water flow over and around the valve V as and when it is lifted and initially permits controlled flow downwardly over the jet opening. After lifting the flush valve V to its height limit and upon its release, said floatable valve is permitted to float downward with the drop of water from the primer tank P, until it reaches the discharge of supply tank water discharging from the jet opening 24. A feature is that premature closure of the flush valve V is prevented by the flow of supply tank water from the jet opening 24, as next described.

The valve seat 25 is immediate to the inner diameter of the flush pipe 23 and is typically upwardly and outwardly inclined at an angle to interface with the engaging surface of the flush valve V that seats thereon. As shown, the sealing face 26 of the flush valve V is conical at the same angle as said seat 25, for example at 45°. In accordance with this invention, the jet opening 24 is downwardly and inwardly declined at a lesser angle than said face 26, for example at 35°. Therefore, the thrust of supply tank water discharged against the face 26 causes an upward reaction that supports the flush valve V until the flow of water subsides, whereeupon the flush valve V drops onto the seat 25.

Figure 1:
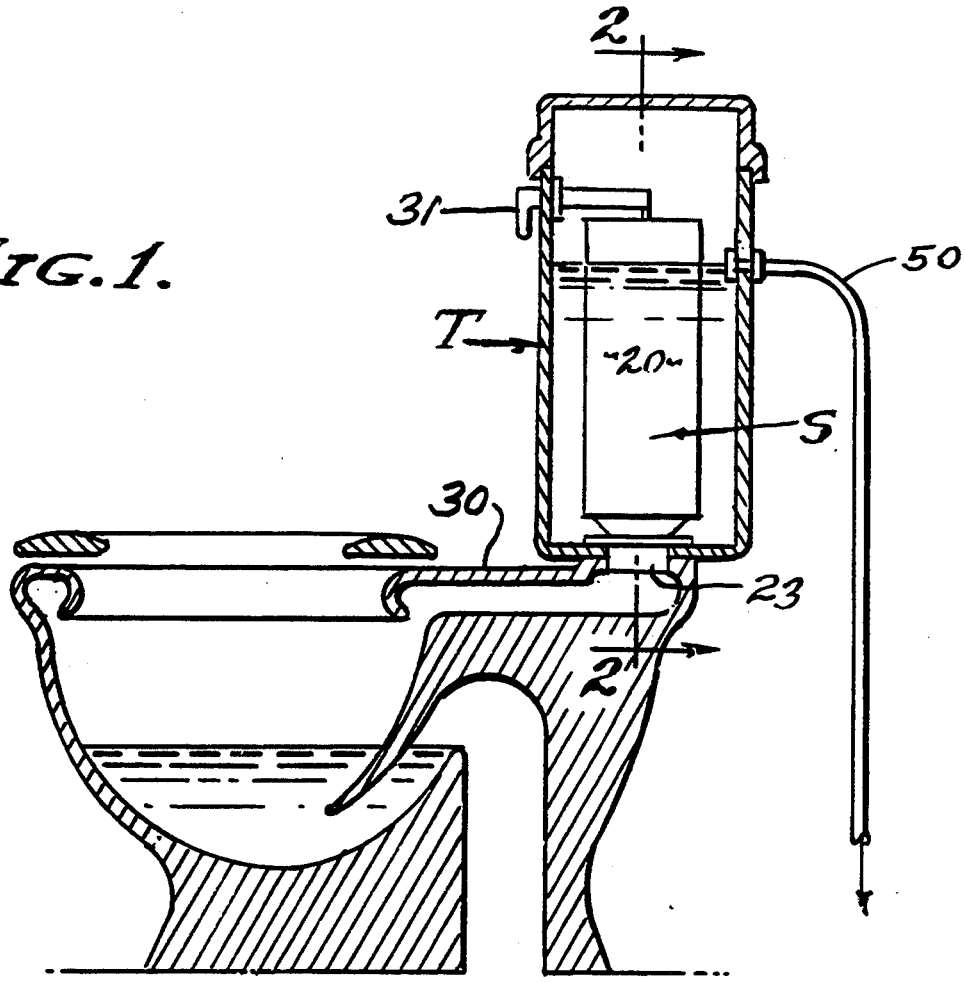
FIG. 1 is a cross sectional view of a toilet with a Warning Pipe discharge and the flushing apparatus of the present invention installed therein.

As shown throughout the drawings, the float controlled level of water in the supply tank T is substantially below the bridge 10 of the syphon. In the United States this will prevail in the reduction of the amount of flush water used (lower the level). And in the United Kingdom this is mandatory in the use of the Warning Pipe 50 as shown in FIG. 1, opening from the supply tank T at the float controlled water level. Accordingly, there is dimension L specified as 64 mm (see FIG. 3) that determines the height that water must be lifted to prime the syphon. This distance requires the discrete use of primer tank water, made effective herein by controlling the rate of discharge so as to prolong the jet action and its water lifting function.

In accordance with this invention, the header 13 closes the top of the primer tank P and a vent-control means C regulates the transfer of air into and out of the primer tank chamber 35 above the water level therein. From an examination of FIG. 3 it will be observed that air must be exhausted from chamber 35 in order for the primer tank to fill with water, whereas from FIG. 4 it will be observed that air must enter chamber 35 in order to permit the discharge of water through the seat 25. The filling condition takes place relatively slowly by means of charging water into chamber 35 from the float controlled valve 46 and through a fill pipe 47 entering through header 13 at an air-tight fitting 48. As shown throughout the drawings, a lift rod 36 lifts the stem 37 of the flush valve V, said lift rod passing freely through a close fitting opening 38 in the header 13. In practice and as shown best in FIG. 8, there is an annular aperture surrounding the lift rod 36 and through which air is permitted to vent slowly to atmosphere when the primer tank is filling with water. Conversely, air is metered from outside atmosphere and into the primer tank chamber 35 when the primer tank is discharging water. Accordingly, the primer tank is permitted to fill, or water discharge therefrom is retarded as required.

The vent-control means C involves the aforementioned aperture opening 38 for basic venting and discharge damping. However, increased discharge rate of flow can be required, and this is provided for by adjusting the aperture (38) and preferably by means of an infinitely variable orifice 39 closed by an adjustable blind member 40 positioned by a set screw 41. The opening 38 and/or orifice 39 are adjusted to restrict the in-flow of air in order to retard the discharge of primer tank water as required to prolong the jet action effect that lifts suction leg water over the syphon bridge 10.

Refilling of the syphon requires a controlled exhaust to atmosphere from the legs 11 and 12 via the transfer passage 14, and to this end I provide a passageway or breather means B. This breather means B is preferably comprised of a breather vent 28 from the transfer passage 14 and through a port 29' into the flush pipe 23 below the flush valve seat 25, so that there is open communication to atmosphere through the flush rim 30 of the toilet (see FIG. 1). The passive ready condition shown in FIG. 6 clearly illustrates this open vented communication, the discharge leg of the syphon being filled up to the bridge 10. In the flush condition as shown in FIG. 4, primer tank water immediately covers and closes the vent port 29', so that it is occluded from the outside atmosphere, whereby the transfer chamber is instantaneously sealed in order to support the syphon effect. The port 29' remains closed to atmosphere until the supply tank water is completely discharged, and thereupon is opened for refilling the supply tank and primer tank to the passive ready condition. It will be observed that the required automation is achieved without moving parts, venting the tranfer chamber 14 in the passive mode, and closing the port 29' to seal the transfer chamber in the flush mode, all of which is inherently operative. The float controlled filler valve 46 remains as a leakage factor, which could result in an overflow from tank T, providing that the flush valve V is effectively leakproof, and leakage of flush valve V disables the ready condition and requires refilling of the primer tank P and preferably repair of the valve V and/or its seat 25. Overflow as may be caused by a leaking filler valve 46 is diverted as waste water through the overflow standpipe 49, or Warning Pipe 50. The standpipe 41 opens from the supply tank water level and discharges via passage 42 into the flush pipe 23 below the flush valve seat 25. The Warning Pipe 50 opens from the supply tank water level and discharges externally though the said Warning Pipe.

This flushing system features the absence of continuous water leakage by valves which have heretofore become defective. Only one small primer tankful of water can be lost through malfunction of the flush valve V. This renders this system superior with respect to the relatively large volume of water stored in the supply tank ready for flushing and which continuously leaks as waste water in conventional non-syphon toilets. Water is inherently conserved when practicing this invention.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A primer tank activated syphon flusher for toilets having a flush tank and a flush pipe opening into a toilet bowl, and having a water level control means responsive to depletion of water in said flush tank to refill said primer tank and said flush tank to predetermined water levels, and including;

a syphon within the flush tank and comprised of a suction leg opening within the bottom of the flush tank and extending upward to a bridge substantially above the aforesaid predetermined water-level, and a discharge leg continuing from the suction leg and extending downward from the bridge and discharging through a jet opening and into the flush pipe, a header spaced above the bridge to define a closed transfer passage connecting the suction leg and discharge leg of the syphon, there being a breather passageway communicating the transfer passage so as to allow air flow to the atmosphere external of the tank and bowl while permitting free exhaust of air for refilling the two legs of the syphon, the primer tank being passively closed at a bottom discharge opening into the flush pipe by a flush valve seated on said flush pipe, and closed at its top to outside atmosphere by a header, there being a vent-control means for restricting air flow into the primer tank to permit refilling with primer water and to create a partial vacuum to retard discharge of said primer water, and means for opening the flush valve to initiate syphoning by discharge of primer water over the jet opening for inducing a suction effect causing suction leg water to rise over the bridge from said predetermined water level and into the discharge leg and from said jet opening into the flush pipe, and continuing until the flush tank water is depleted.

2. The primer tank activated syphon flusher for toilets as set forth in claim 1, wherein the header spaced above the bridge and the header at the top of the primer tank are coplanar.

3. The primer tank activated syphon flusher for toilets as set forth in claim 1, wherein the discharge leg of the syphon surrounds a tubular wall of the primer tank and at the bottom of which tubular wall the jet opening discharges annularly into the flush pipe.

4. The primer tank activated syphon flusher for toilets as set forth in claim 1, wherein the suction leg, discharge leg and primer tank are formed of concentric tubes, the discharge leg of the syphon and the primer tank sharing a common tubular wall at the bottom of which the jet opening discharges annularly and into the flush pipe.

5. The primer tank activated syphon flusher for toilets as set forth in claim 1, wherein the passageway communicating from the transfer passage is comprised of a vent opening above the syphon bridge and from the transfer passage to a port immediately below the flush valve seat and into the flush pipe and open to outside atmosphere via the toilet bowl in the passive ready to flush mode, and closed by primer tank water in the flush mode by occluding said port from outside atmosphere and thereby enabling the syphon effect.

6. The primer tank activated syphon flusher for toilets as set forth in claim 1, wherein the vent-control means for restricting air flow into the primer tank is comprised of an orifice through the header closing the top of the primer tank.

7. The primer tank activated syphon flusher for toilets as set forth in claim 1, wherein the vent-control means for restricting air flow into the primer tank is comprised of a size adjusted orifice through the header closing the top of the primer tank.

8. The primer tank activated syphon flusher for toilets as set forth in claim 1, wherein the vent-control means for restricting air flow into the primer tank includes a blind member positioned over an orifice by adjustment means.

9. The primer tank activated syphon flusher for toilets as set forth in claim 1, wherein the vent-control means for restricting air flow into the primer tank includes a blind member positioned over an orifice by a set screw.

10. The primer tank activated syphon flusher for toilets as set forth in claim 1, wherein the vent-control means for restricting air flow into the primer tank is comprised of an annulus formed by an orifice opening freely passing a lift rod of the means for opening the flush valve.

11. The primer tank activated syphon flusher for toilets as set forth in claim 1, wherein the vent-control means for restricting air flow into the primer tank is comprised of an annulus formed by an orifice opening freely passing a lift rod of the means to lift a stem of the flush valve.

12. The primer tank activated syphon flusher for tolets as set forth in claim 1, wherein the flush valve is floatable and wherein the vent-control means for restricting air flow into the primer tank is comprised of an annulus formed by an orifice opening freely passing a lift rod of the means for opening the flush valve.

13. The primer tank activated syphon flusher for toilets as set forth in claim 1, wherein the flush valve is floatable and wherein the vent-control means for restricting air flow into the primer tank is comprised of an annulus formed by an orifice opening freely passing a lift rod of the means for opening the flush valve by lifting a stem thereof.

* * * * *